US005543015A

United States Patent [19]

Jermo

[11] Patent Number: 5,543,015

[45] Date of Patent: Aug. 6, 1996

[54] GROOVE CONFIGURATION FOR A PRESS BELT IN AN EXTENDED NIP PRESS

[75] Inventor: Olli A. Jermo, Tampere, Finland

[73] Assignee: Tamfelt Corp., Tampere, Finland

[21] Appl. No.: 324,742

[22] Filed: Oct. 18, 1994

[51] Int. Cl.[6] ..... D21F 3/02

[52] U.S. Cl. ..... 162/358.4; 162/901; 198/847; 428/179; 428/182

[58] Field of Search ..... 162/358.4, 901; 198/844.1, 847; 428/179, 182

[56] References Cited

U.S. PATENT DOCUMENTS

| | | | |
|---|---|---|---|
| 3,059,758 | 10/1962 | Walker | 198/847 |
| 3,537,571 | 11/1970 | Wiese | 198/846 |
| 3,630,340 | 12/1971 | Bouzat | 198/847 |
| 3,853,016 | 12/1974 | Lane, III et al. | 198/847 |
| 4,004,467 | 1/1977 | Kenney | 198/847 |
| 4,311,474 | 1/1982 | Standley | 198/847 |
| 4,482,430 | 11/1984 | Majaniemi | 162/358.4 |
| 4,496,429 | 1/1985 | Salminen et al. | 162/358.4 |
| 4,880,501 | 11/1989 | Schiel | 162/358.4 |
| 4,908,103 | 3/1990 | Cronin et al. | 162/358.4 |
| 4,946,731 | 8/1990 | Dutt | 428/156 |
| 5,141,101 | 8/1992 | Vance | 198/847 |
| 5,302,251 | 4/1994 | Schiel et al. | 162/358.4 |

FOREIGN PATENT DOCUMENTS 2221702 2/1990 United Kingdom .

*Primary Examiner*—Karen M. Hastings
*Attorney, Agent, or Firm*—Salter & Michaelson

[57] ABSTRACT

The grooves of a grooved press belt are formed with an improved configuration which reduces groove closure under pressure and which reduces cracking and tearing of the belt. The improved groove configuration consists of a curved bottom and two upwardly diverging side walls. In a first embodiment the bottom wall is semi-circular and has a diameter which is equal to about one half of the width of the groove opening. The upwardly diverging side walls preferably include radiused upper edges. The side walls preferably have an angle of divergence between about five degrees and about fifteen degrees from a vertical plane. In a second embodiment, the bottom of the groove is substantially flat, and the bottom corners are radiused to provide a smooth transition between the flat bottom and the upwardly diverging side walls.

6 Claims, 3 Drawing Sheets

GROOVE CONFIGURATION FOR A PRESS BELT IN AN EXTENDED NIP PRESS

BACKGROUND AND SUMMARY OF THE INVENTION

The instant invention relates to grooved press belts for use in paper making machinery, and other like machinery, and more particularly to an improved groove configuration for such press belts.

Press belts are used in various press devices, such as shoe-type presses, as used in paper making machines and calendars, to transport a continuous sheet through a press nip. The prior art press belts typically comprise a polyurethane or rubber material having a reinforcing fiber weave imbedded therein. In the paper making art, it is well known to provide grooves in the outer surface of a press belt in order to provide a channel to carry water away from the sheet as it is being pressed. In this connection, grooves are usually formed with a rectangular cross-section. However, there are two significant problems with conventional rectangular groove configurations. The first problem is that rectangular shaped grooves have a natural tendency to close under pressure of the nip. The pressure of the nip deforms the lands between the grooves forcing the sides of the grooves toward each other and thereby closing the groove. Several solutions have been proposed for the problem of groove closure. However, none of the proposed solutions appear to be satisfactory. U.S. Pat. No. 4,880,501 discloses a groove configuration wherein the tops of the lands are formed with a concave shape. This concave formation is believed to reduce the deformation of the land. However, this type of machining is very difficult to accomplish, and furthermore it does not completely eliminate groove closure. U.S. Pat. No. 4,908,103 discloses a press belt having an outer surface which is constructed of a harder material which is not as likely to be elastically deformed. However, the use of two different elastomers leads to problems with delamination or separation of the two elastomer layers. British Patent No. GB 8818992.3 discloses a press belt wherein cross-pieces extend between the lands to provide to support the lands. However, reinforcing cross-pieces reduce the efficiency of the grooves by hindering the flow of water once in the grooves. Furthermore, the cross-pieces are difficult to machine.

The second problem associated with conventional rectangular groove configurations is the tendency for the lands to break off at their base. Cracking of the belt leads to shortened life span, increased belt replacement, and increased machine down time. In this regard, it has been found that the cumulative stress of repeatedly passing through the nip causes the lands to crack at their bottom edges. The sharp corners of the rectangular grooves create stress points in the material wherein the maximum stress often exceeds four times the stress elsewhere in the material. In order to remedy this problem, it is has been suggested to make the grooved surface of the belt from a harder elastomer. However, there is the problem of delamination, as indicated earlier. In addition, harder elastomers generally have less tolerance for repeated bending as would be required in an press belt. One solution which has been suggested is to provide the elastomer with reinforcing threads (U.S. Pat. No. 4,946,731). However, when a plurality of filaments are used to reinforce the elastomer, cutting of the grooves exposes the matrix of fibers and opens paths for water to get inside the belt and cause failure. Yet another solution is to provide filaments located within the lands (GB 8818992.3). However, precise location of the filaments and machining of the grooves so that the filaments lie within the lands is extremely difficult, leading to a high percentage of substandard belts or belt rejections.

Accordingly, among the objects of the instant invention are: the provision of a groove configuration for a press belt which effectively reduces groove closure; the provision of a groove configuration which reduces cracking of the belt; and the provision of a groove configuration which is simple and inexpensive to machine.

The above objects are accomplished by providing a groove configuration wherein the grooves are formed with an arcuate bottom and two upwardly diverging side walls. The arcuate bottom is preferably semi-circular and has a diameter which is equal to about one half of the width of the groove opening. The upwardly diverging side walls preferably include radiused upper edges which provide a smooth curved transition between the side walls and the outer surface of the press belt. Each side wall preferably has an angle of divergence between about five (5) degrees and about fifteen (15) degrees from a vertical plane. In a second embodiment, the groove is formed with a substantially flat bottom and radiused corners which provide a smooth transition between the flat bottom and the upwardly diverging side walls.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
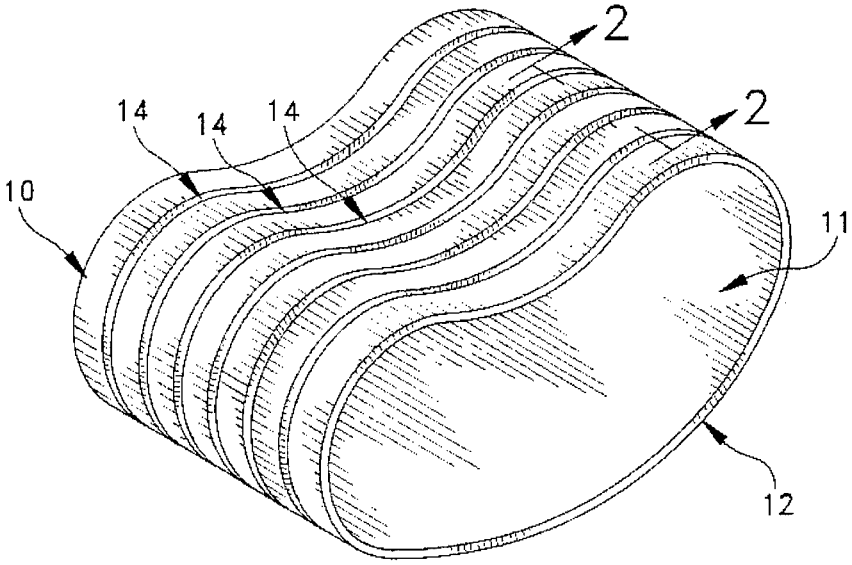
FIG. 1 is a perspective view of a grooved press belt incorporating the groove configuration of the instant invention.
Figure 2:
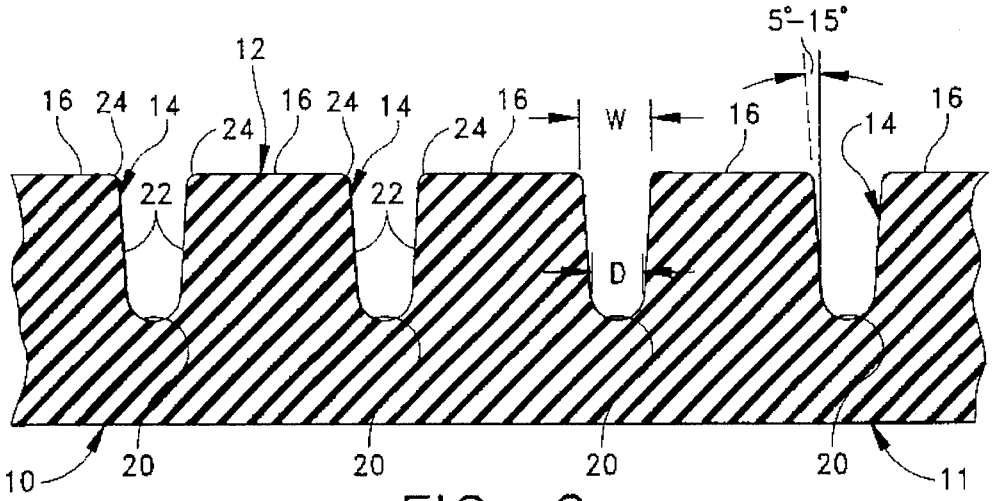
FIG. 2 is a fragmentary cross-sectional view thereof taken along line 2—2 of FIG. 1.
Figure 3:
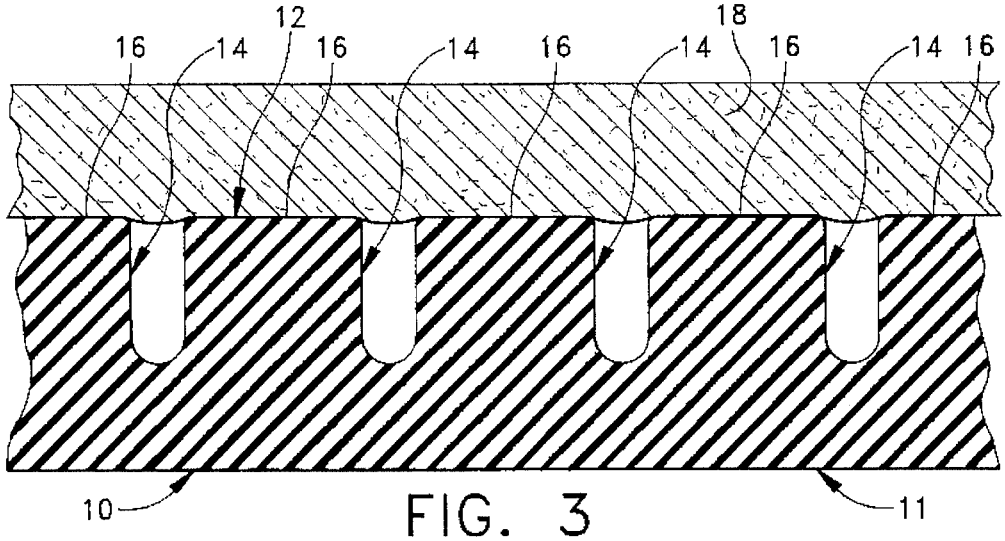
FIG. 3 is another fragmentary cross-sectional view showing the press belt under compression.

Referring now to the drawings, a first embodiment of the press belt of the instant invention is illustrated and generally indicated at 10 in FIGS. 1–3. As will hereinafter be more fully described, the belt 10 includes a groove configuration which reduces groove closure under compression and which reduces cracking of the belt at the bottom corners of the grooves.

Press belt 10 comprises a continuous loop of elastomeric material which is formed by known belt forming techniques. Press belt 10 includes inner and outer surfaces generally indicated at 11, 12, and further includes a lengthwise spiralling groove generally indicated at 14. In use, the outer grooved surface 12 of the belt 10 makes contact with a sheet 18 (FIG. 3) to be pressed. The spiral groove 14 actually forms a plurality of lengthwise longitudinal grooves which are separated by lands 16. Press belts 10 are generally formed with a thickness between about 3–6 mm. Groove 14 is generally 0.5 to 1.0 mm wide with the lands 16 generally 2–5 times the width of the groove 14. While groove 14 has been illustrated as extending lengthwise to the direction of belt 10, it is to be understood that the direction of the groove(s) is not critical to the operation of the belt. Accordingly, grooves 14 may alternatively extend either crosswise, or at an angle to the direction of the belt. The groove 14 is formed with an arcuate bottom 20, and two upwardly diverging side walls 22. Arcuate bottom 20 preferably has a diameter (D) which is equal to about one half of the width (W) of the groove opening (See FIG. 2). Diverging walls 22 are preferably formed with radiused top edges 24 which provide a smooth transition between side walls 22 and outer surface 12. As illustrated in FIG. 2, each side wall 22 preferably has an angle of divergence between about five (5) degrees and about fifteen (15) degrees from a vertical plane, although both smaller and larger angles of divergence are acceptable.

Figure 5:
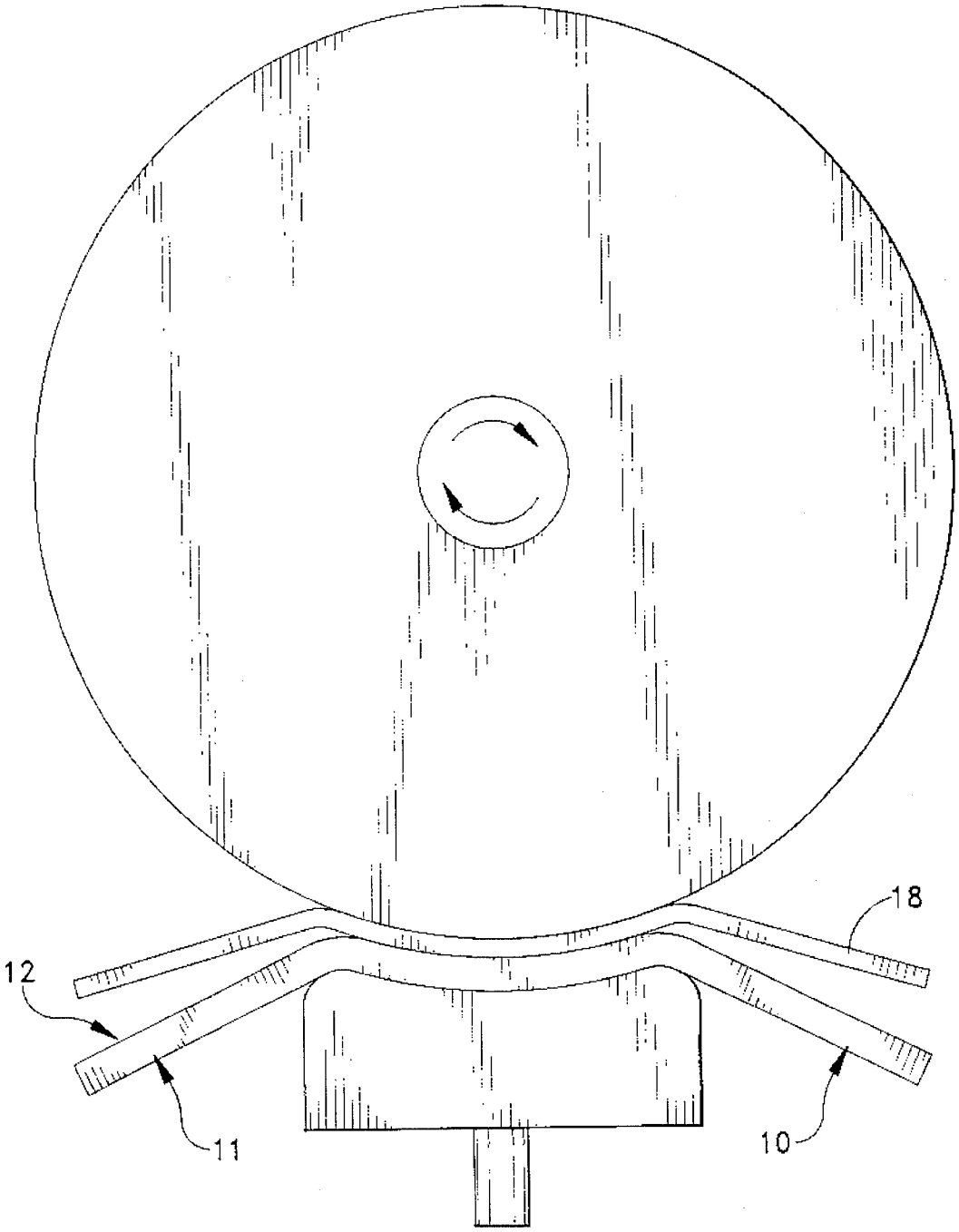
FIG. 5 is an elevational view of a shoe-type extended nip press device.

Referring now to FIG. 3, press belt 10 is shown in conjunction with sheet 18 which is being pressed in a shoe type pressing device, i.e. an extended nip press device as shown in FIG. 5. While the side walls 22 of groove 14 still tend to deform inwardly under compression, the diverging configuration of the side walls 22 compensates for the compression. The resulting groove 14 (FIG. 3) is thus generally rectangular in shape. Curved bottom 20 of groove 14 more evenly distributes the stress of the nip compression, and therefore reduces cracking and failure of the belt 10. It has been found that the stress at the transition points between the bottom 20 and side walls 22 has been effectively reduced to about 1.1 times the normal stress on the material elsewhere in the belt. As discussed previously, the maximum stress caused by a sharp corner often exceed four times the normal stress. The life of press belt 10 is thus extended by a significant amount of time over the prior art press belts.

Figure 4:
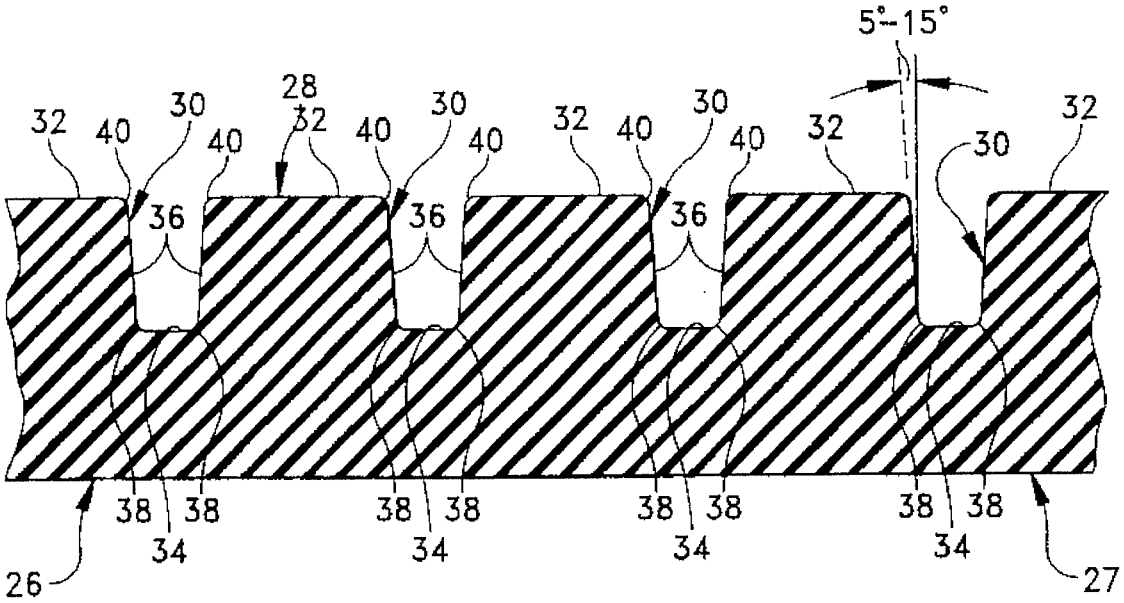
FIG. 4 is a fragmentary cross-sectional view of a second embodiment of the groove configuration.

Referring now to FIG. 4, a second embodiment of the press belt is illustrated and generally indicated at 26. Press belt 26 includes inner and outer surfaces generally indicated at 27, 28, and lengthwise spiralling groove generally indicated at 30. Unlike press belt 10, grooves 30 are formed with a substantially flat bottom 34, upwardly diverging side walls 36, and radiused bottom corners 38 which provide a smooth transition between the flat bottom 34 and the diverging side walls 36. The side walls 36 are preferably formed with radiused upper edges 40. Each side wall 36 preferably has an angle of divergence between about five (5) degrees and about fifteen (15) degrees from a vertical plane.

In use, the diverging side walls 36 of the grooves 30 compensate for elastic deformation of the lands 32 under compression thereby resulting in a rectangular groove. The radiused corners 38 more evenly distribute the stress of the nip compression and therefore reduce cracking and failure of the belt 26.

It can therefore be seen that the instant invention provides a unique and novel groove configuration for a press belt. The groove configuration includes rounded or radiused corners which effectively reduce structural stress at the transitions between the bottom and side walls of the groove. The outwardly diverging walls of the grooves compensate for elastic deformation of the press belt and thus provide a generally rectangular groove for carrying away water from the sheet being pressed. For these reasons, the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. An endless elastomeric press belt in an extended nip press including a press shoe, said press belt transporting a sheet of material through the extended nip press, said press belt including an outer surface which is received in engagement with the sheet of material to be pressed, and further including an opposing inner surface, said press belt further including a plurality of upwardly opening longitudinal grooves formed in the outer surface thereof for carrying a liquid away from said sheet of material, each of said grooves comprising an arcuate bottom wall, and two opposing planar sidewalls which diverge upwardly from opposite ends of the arcuate bottom wall and merge with the outer surface of the belt at upper edges of the side walls, said upper edges being radiuses to provide a smooth transition between said side walls and said outer surface.

2. The press belt of claim 1, wherein said side walls have an angle of divergence between about five degrees and about fifteen degrees from a plane extending perpendicular to the outer surface.

3. The press belt of claim 1, wherein said bottom wall is semicircular in shape and has a diameter which is equal to about one-half of a width of the groove opening.

4. The press belt of claim 2, wherein said bottom wall is semicircular in shape and has a diameter which is equal to about one-half of a width of the groove opening.

5. An endless elastomeric press belt in an extended nip press including a press shoe, said press belt transporting a sheet of material through the extend nip press, said press belt including an outer surface which is received in engagement with the sheet of material to be pressed, and further including an opposing inner surface, said press belt further including a plurality of upwardly opening longitudinal grooves formed in the outer surface thereof for carrying a liquid away from said sheet of material, each of said grooves comprising a flat bottom wall extending generally parallel with the outer surface of the belt, and two opposing planar sidewalls which diverge upwardly from bottom corners of the bottom wall and merge with the outer surface of the belt at upper edges of the side walls, said bottom corners being radiuses to provide a smooth transition between the bottom wall and the side walls, and said upper edges being radiused to provide a smooth transition between said side walls and said outer surface.

6. In the press belt of claim 5, said side walls having an angle of divergence between about five degrees and about fifteen degrees from a plane extending perpendicular to the outer surface.

* * * * *